United States Patent [19]

Leiviskä

[11] 4,375,188

[45] Mar. 1, 1983

[54] ON-MACHINE SUPERCALENDER APPARATUS

[75] Inventor: Veikko Leiviskä, Porvoo, Finland

[73] Assignee: Valmet Oy, Finland

[21] Appl. No.: 271,237

[22] Filed: Jun. 8, 1981

[30] Foreign Application Priority Data

Jun. 10, 1980 [FI] Finland ..... 801853

[51] Int. Cl.[3] ..... B30B 3/04

[52] U.S. Cl. ..... 100/162 R; 100/168

[58] Field of Search ..... 100/160, 161, 162 R, 100/163 R, 163 A, 167, 168, 170, 173; 162/361

[56] References Cited

U.S. PATENT DOCUMENTS

| | | | |
|---|---|---|---|
| 715,017 | 12/1902 | Cameron | 100/167 X |
| 2,300,994 | 11/1942 | Thiele et al. | 100/163 R |
| 3,905,288 | 9/1975 | Holm | 100/162 R |
| 4,128,053 | 12/1978 | Kankaanpaa | 100/162 R |
| 4,131,063 | 12/1978 | Joutsjoki | 100/162 R |

*Primary Examiner*—Peter Feldman

*Attorney, Agent, or Firm*—Steinberg & Raskin

[57] ABSTRACT

On-machine supercalender apparatus adapted to be located at the discharge end of a paper making machine of the type which includes hard and soft calender rolls forming soft calendering nips with each other. The calender rolls are arranged in at least three roll groups, each of the calender roll groups consisting of three calender rolls, namely a central hard calender roll and two outer soft calender rolls. The calender roll groups are separate from each other in that the calender rolls of one group are neither directly or indirectly in nip contact with the calender rolls of another group. At least a majority of the soft calender rolls are replaceable during operation of the apparatus without any significant interruption in operation.

6 Claims, 5 Drawing Figures

ON-MACHINE SUPERCALENDER APPARATUS

BACKGROUND OF THE INVENTION

This invention relates to on-machine supercalender apparatus adapted to be located at the output side of a paper machine and which comprise both hard and soft calender rolls which form soft calendering nips with each other. More particularly, this invention relates to on-machine supercalender apparatus wherein the calender rolls are arranged in at least three roll groups each of which consists of three rolls and wherein the roll groups are arranged separate from each other, i.e., the rolls of different roll groups are neither directly nor indirectly in nip contact with each other.

The calendering of a paper web leaving the discharge end of a paper machine is a well known final finishing treatment for determining the smoothness and gloss of the surfaces of the paper as well as its consistency or density. Such calendering is generally accomplished by guiding a continuous paper web successively through a series of nips formed by calender rolls.

Conventionally, a paper web is calendered in a so-called machine calender directly connected to the output side of the paper machine and, when required, the treatment is completed in a separate so-called supercalender.

Calender apparatus comprise calender rolls which define calender nips through which the web is passed. Such calender rolls constitute either "hard" rolls or "soft" rolls. It is understood that as used herein, the term hard rolls designates rolls formed, for example, of chill casting or steel, the hard surfaces of which have been ground smooth. The term soft rolls as used herein designates rolls whose surfaces are made of flexible or resilient material. For example, a resilient material generally used for such soft rolls is paper wrapped in layers around the shaft of the roll and compressed to form a uniform roll coating.

Furthermore, as used herein, the term ¢soft nip" designates the contact line between a soft roll and a hard roll. The term "hard nip" is used to designate the contact line formed between two hard rolls.

It is possible depending upon the type of paper and the requirements therefor to machine-calender the paper web in a single nip calender, i.e., a calender comprising only one pair of rolls. In most cases, however, a machine-calender will comprise four to eight rolls forming three to seven nips.

It is usually an object in supercalendering operations to provide both sides of the paper web with an equal gloss. Accordingly, at least two soft nips are provided located in a manner such that both surfaces of the paper web are pressed against the surface of a hard roll. Separate supercalender apparatus can comprise up to ten nip pairs.

In connection with improving the efficiency of paper production, it has become important to provide calender apparatus in which both the functions of a machine calender as well as a supercalender are combined. In this connection, Finnish patent application No. 761764 discloses an on-machine supercalender apparatus adapted to be connected to a paper machine. This supercalender comprises a stack of rolls including conventional hard rolls and essentially the same number of soft rolls which are located outside of the roll stack to form soft nips against the hard rolls.

In such calender apparatus which combine the functions of both a machine calender and a supercalender, the paper web can be supercalendered as desired immediately after the same leaves the paper machine without any intermediate phases. However, the results obtained are not entirely satisfactory in that the so-called super gloss obtained by the paper by such calendering treatment is not uniform. In other words, some areas of the surface of the paper are glossier than other areas. Furthermore, it has been found that the paper web subjected to the calendering treatment turns a blackish color resulting at least partially from the fact that the hard nips are in fact too hard and insufficiently flexible or resilient.

As to the state of the art relative to the present invention, reference is made to Finnish Pat. No. 55694 and Finnish patent applications Nos. 793200 and 793201.

Thus, the starting point of the present invention is the observation that soft rolls of a calender, such as the paper rolls described above, are easily damaged during operation. This is disadvantageous in that the ratio of down time to production time becomes quite high.

Conventional calenders are known which are composed of groups of three or more rolls. It has not been possible in such calenders to replace a soft roll when the same is damaged during operation of the machine. In certain conventional four nip calenders, although it is possible to change a soft roll during operation without breaking the web, this results in one surface of the web being totally uncalendered.

As mentioned above, the soft rolls utilized in supercalendering become worn relatively rapidly and frequently become damaged during operation. On the other hand, since the decision to utilize an on-machine supercalender instead of the traditional supercalender depends on the extent to which the output of production of the paper machine is reduced due to the use of the on-machine supercalender located at the output end of the paper machine, it is of primary importance to minimize the duration of interruptions in production incurred during replacement of the calender rolls and especially the soft calender rolls.

SUMMARY OF THE INVENTION

Accordingly, one object of the present invention is to provide new and improved calender apparatus having an improved output, i.e., where the ratio of down or standing time to production time is minimized.

Another object of the present invention is to provide new and improved calender apparatus wherein the duration of production interruptions is minimized and wherein at the same time the number of rolls in the calender can be maintained relatively low.

Still another object of the present invention is to provide new and improved calender apparatus wherein a damaged soft roll can be replaced during continued operation of the apparatus.

According to the present invention, these and other objects are obtained by providing calender apparatus including groups of calender rolls, each roll group including a central, hard calender roll and two outer, soft calender rolls forming soft calendering nips with the hard central roll and wherein at least a majority of the soft rolls can be replaced while the apparatus is in operation without any significant interruption in production.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
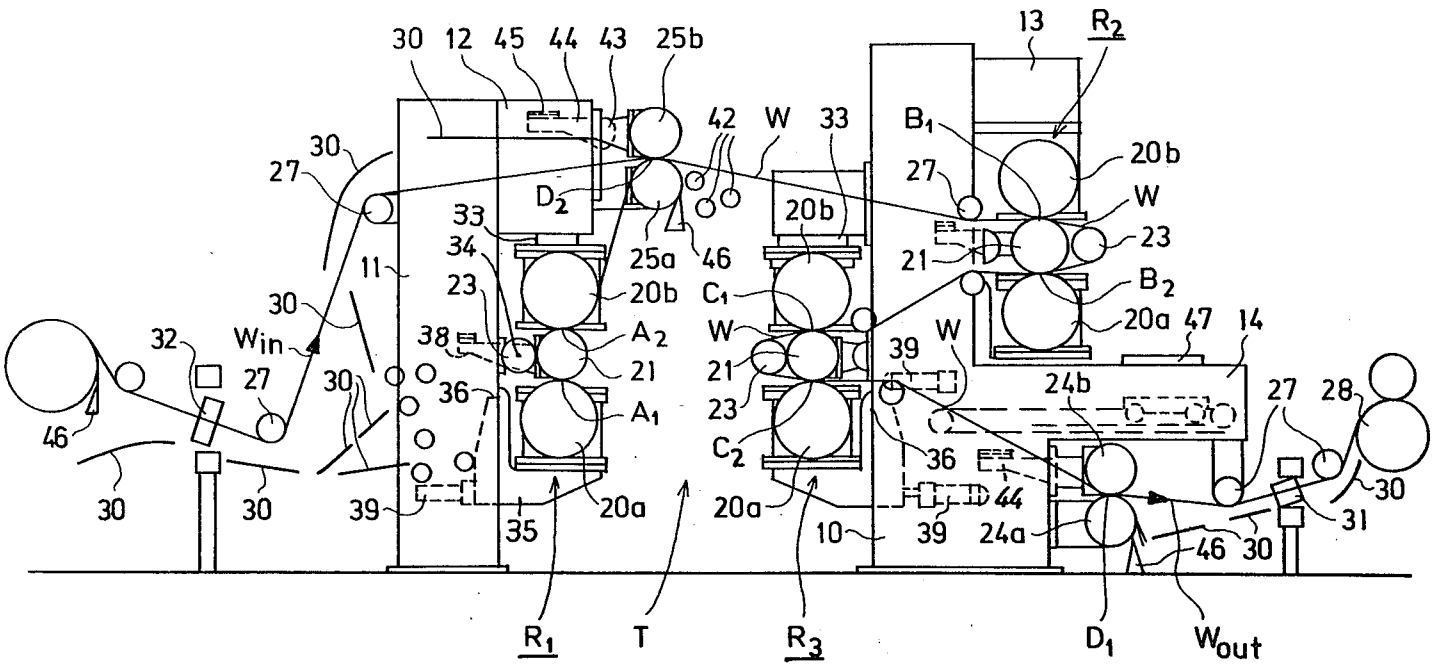
FIG. 1 is a schematic side elevation view of one embodiment of calender apparatus according to the present invention.
Figure 2:
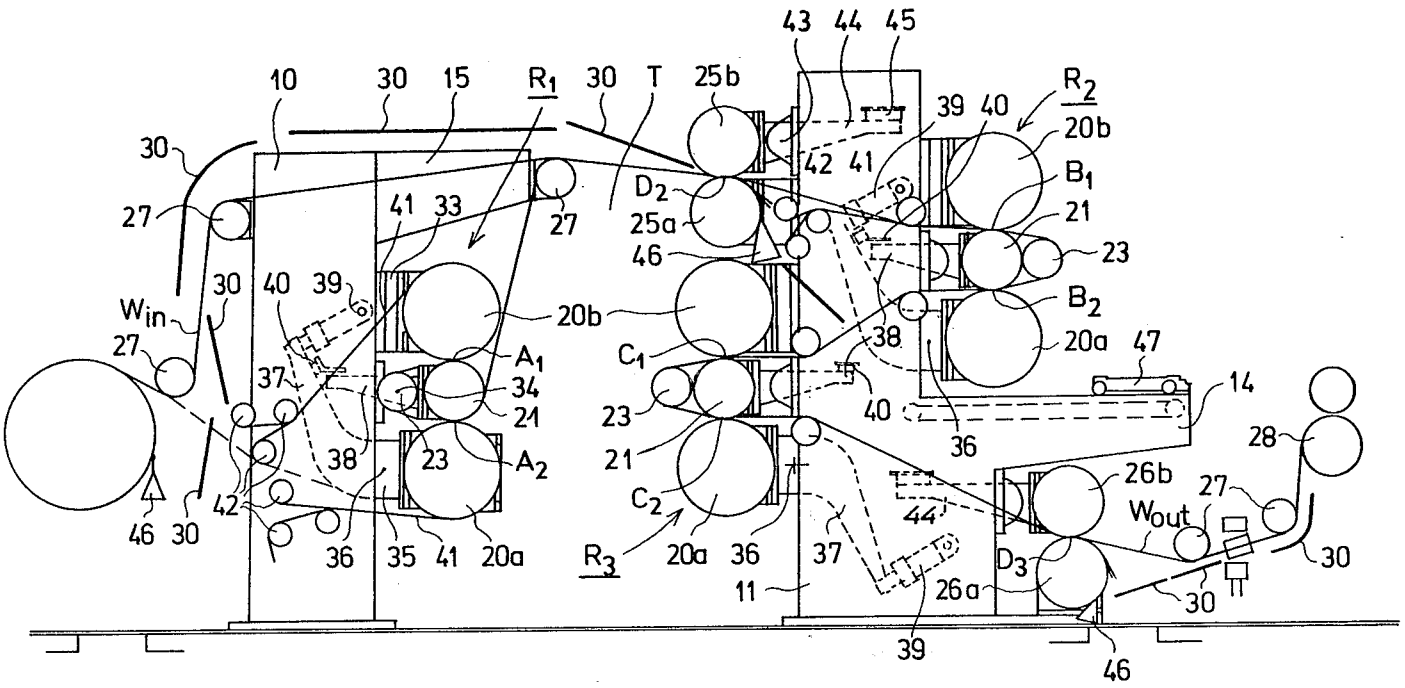
FIG. 2 is a schematic side elevation view of another embodiment of calender apparatus according to the present invention.

Referring now to the drawings wherein like reference characters designate identical or corresponding parts throughout the several views, and more particularly to FIGS. 1 and 2, the calender apparatus includes frame structure constituted by frame columns 10 and 11. In the embodiment illustrated in FIG. 1, horizontally extending frame projections 12 and 13 extend from the upper ends of frame columns 11 and 10, respectively. Further, a relatively long horizontal frame projection 14 extends from a lower portion of the frame column 10 in both embodiments.

Referring to FIG. 1, a first calender roll group $R_1$ is mounted in a manner described below to the frame components 11 and 12 while calender roll groups $R_2$ and $R_3$ are mounted on respective sides of the frame column 10. In the embodiment of FIG. 2, the first calender roll group $R_1$ is mounted on frame column 10 while the third calender roll group $R_3$ is mounted in opposed relationship to the calender roll group $R_1$ to frame column 11 while the second calender roll group $R_2$ is mounted on the rear side of frame column 11 as viewed in the direction of the run of web W.

According to the present invention, each of the calender roll groups R comprise three calender rolls. More particularly, each calender roll group R includes a central hard roll 21 such, for example, as a chill-cast roll, and two outer soft calender rolls **20*a* and 20*b* such, for example, as paper rolls described above. Further, a guide roll 23** is preferably associated with each of the calender roll groups although this is not necessary in all cases.

Each of the calender roll groups R therefore includes two soft nips through which the web W passes, the web W being detached from the hard central roll 21 to pass over the guide roll 23. Thus, roll group $R_1$ defines calendering nips $A_1$ and $A_2$, roll group $R_2$ defines calendering nips $B_1$ and $B_2$ and roll group $R_3$ defines calendering nips $C_1$ and $C_2$.

Traction nips D are provided in each of the embodiments illustrated in FIGS. 1 and 2 which function so as to facilitate the guidance and running of the web W, such traction nips not having any calendering or polishing function. More particularly, the calender apparatus illustrated in FIG. 1 include traction nips $D_1$ and $D_2$ while the apparatus illustrated in FIG. 2 include traction nips $D_2$ and $D_3$. The traction nips D are formed, for example, between a lower hard roll **24*a*, 25*a*, 26*a* and an upper, rubber-coated roll 24*b*, 25*b* and 26*b*, respectively. The hard lower rolls 24*a*, 25*a*, 26*a* are mounted on bearing supports which are rigidly fastened to the frame structure while the upper rubber-coated rolls 24*b*, 25*b*, 26*b* are mounted on bearing supports which are connected to arms 44 which are pivotally connected by brackets 43 to the frame structure. Power units 45 are associated with the outer ends of arms 44** so that the latter can be pivoted to open and load the traction nips D.

Referring to the calender rolls **20*a*, 20*b* and 21 which comprise the calender roll groups, the upper soft calender rolls 20*b* are mounted on bearing supports which are connected to the frame structure in a rigid manner by means of stationery supports 33. The central, hard calender rolls 21 are, however, mounted in bearing supports which themselves are articulated to the frame structure 10 and 11 so that the central rolls 21 of each roll group R can move in a substantially vertical plane. In the illustrated embodiment, this connection is accomplished by means of the roller 21 being mounted in bearing supports which are fastened at pivot points 34 to supports arms 38. Stop members 40 (FIG. 2) are provided on the frame structure for limiting the pivotal movement of support arms 38 and to thereby limit the lowermost position to which the central rollers 21 can move, the rollers 21** being capable of being raised from this lower position.

The lower soft calender rolls **20*a* of each roll group R are mounted in bearing supports which are themselves mounted on supports 35 which are pivotally connected at pivot points 36 to the frame columns 10 and 11. The supports 35 in the FIG. 2 embodiment are connected to arms 37 whose outer ends are acted upon by power units 39. In the embodiment of FIG. 1, the supports 35 are directly acted upon by the power units 39. These power units 39 may comprise, for example, hydraulic or pneumatic cylinders and upon their actuation, the supports 35 can be pivoted to thereby load the nip pairs A, B and C with the desired line pressure necessary to perform calendering. Upon deactuation of the power units 39, the nip pairs A, B and C are opened in a rapid manner, the stop members 40 acting to limit the extent to which the calender rolls 20*a* and 21** move downwardly. This in fact contributes to minimizing the duration of production interruption by virtue of the rapid manner in which the nips can be opened.

The portion of the web entering the calender apparatus is denoted in the figures by $W_{in}$ while the portion of the web being discharged from the calender apparatus is designated $W_{out}$. Further, guide rolls 27 are illustrated in the figures, such rolls functioning to guide the web W through the calender apparatus.

Reeling apparatus 28 are provided at the discharge end of the calender apparatus. Further, apparatus 31 and 32 for metering the moisture of the web are provided at the outlet and inlet sides of the calender, respectively. Guide plates 30 are provided for facilitating the threading of the initial end of the web W through the calender, preferably together with suitable blow devices (not shown). The equipment for threading the end of the web through the calender further includes pairs of ropes 41 and pulleys 42 which are in themselves conventional and need not be described for present purposes.

It is an important feature of the present invention that the soft calender rolls may be easily replaced in a rapid manner when the same are damaged or become worn. Thus, the upper soft calender roll **20*b* of group $R_2$ in each of the embodiments illustrated in FIGS. 1 and 2 can be rapidly replaced by using a traverse crane normally found in a paper machine hall. The lower soft calender roll 20***a* in roll group $R_2$ can be replaced by lowering the roll 20*a* onto a car 47 which is provided to traverse the length of the horizontal projection 14 of the frame whereby the car 47 with the roller 20*a* supported thereon is run to the end of projection 14 whereupon the roller 20*a* can be lifted from the car by means of the traverse crane. It is preferable to situate replacement rolls at locations proximate to the calender apparatus at appropriate locations relative to the frame structure so that such replacement rolls can be easily and quickly associated with the apparatus after the removal of the worn or damaged soft rolls 20*a* and 20*b*. For this purpose, a space T is provided between the calender roll groups $R_1$ and $R_3$ both of the embodiments illustrated in FIGS. 1 and 2 in which space equipment for replacing soft rolls are preferably provided.

Figure 3A:
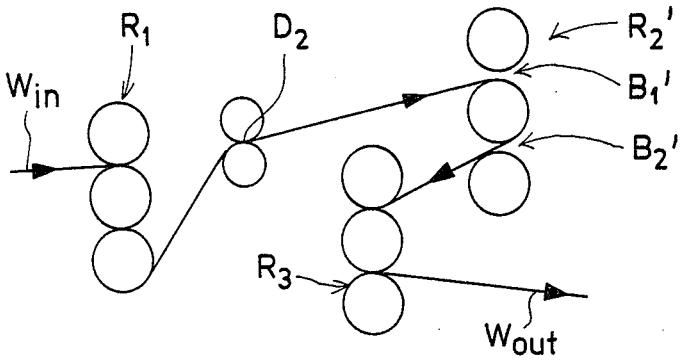
FIGS. 3A, 3B and 3C are schematic illustrations showing three different alternatives by which the paper web is drawn through the calender apparatus.
Figure 3B:
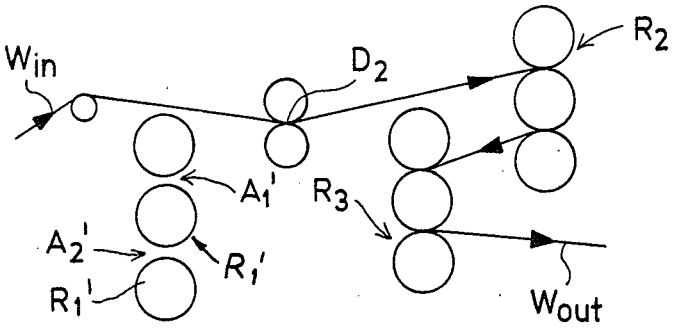
Figure 3C:
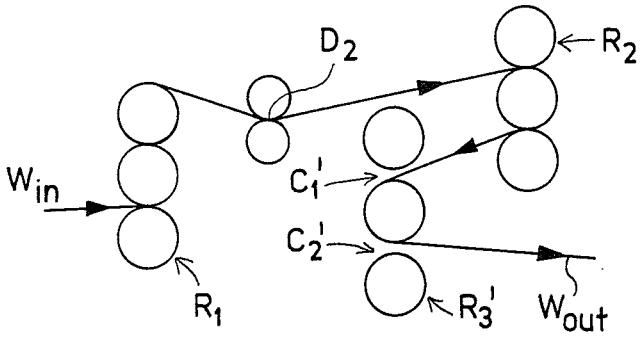

FIGS. 3A, 3B and 3C illustrate three alternative modes of guiding the web through the calender apparatus in accordance with FIGS. 1 and 2. In all of the illustrated techniques, one group of roll R′ is maintained non-operational, i.e., no calendering operation is performed thereby. Such mode of operation recognizes the fact that in most cases, four successive soft nips are generally sufficient to produce the smoothness and glaze properties typical of supercalendered paper. However, it is understood that the scope of the present invention is not limited by the foregoing and that calender apparatus including three or even more roller groups R, each consisting of three calender rolls, are within the scope of the present invention.

Referring to FIG. 3A, the second roll group $R_2'$ maintained non-operational and its calendering nips $B_1'$ and $B_2'$ are maintained open. Both surfaces or faces of the web W will be polished or calendered in accordance with the FIG. 3A guidance of the web.

Referring to FIG. 3B, the first roll group $R_1'$ is maintained non-operational mode with its nips $A_1'$ and $A_2'$ being open. In the mode illustrated in FIG. 3C, the first and second roll groups $R_1$ and $R_2$ are maintained operational while the third roll group $R_3'$ is maintained non-operational with its nips $C_1'$ and $C_2'$ being open. In the modes of operation illustrated in FIGS. 3B and 3C, both surfaces of the web W will alternatively contact soft and hard rolls of the apparatus.

Calender apparatus of the present invention may be adapted for automatic operation in a manner such that if one of the calender rolls, e.g. a soft calender roll, is damaged, all of the nips of the calender will be opened and, if required, the path of the web can be changed depending upon where the roll damage occurs, whereupon the nips are closed and the web run along its new path. After the operation of the apparatus is restarted, the damaged roll can be replaced and any other service operations carried out whereupon the group of rolls in which the damage occurred will remain as a ready-reserve roll group, i.e., a non-operational roll group, which can be placed into operation as soon as damage occurs in some other roll group. In this manner, any interruption in production caused by damage to a calender roll will remain of extremely short duration and, at the same time, a number of rolls used in the calender can be kept relatively low.

As seen in FIGS. 3A and 3C, when a soft roll in one of the roll groups $R_2$ and $R_3$ is damaged, it is possible to replace the same without interrupting the operation of the calender apparatus since the running of the web W is guided only by hard rolls 21 and 23 in these roll groups. When a calender roll is damaged in the roll group $R_1'$, the web is guided as illustrated in FIG. 3B whereupon the damaged roll can be replaced. It is also possible in roll group $R_1$ to arrange that the web W is run so that it is guided only by hard rolls 21 and 23 as is the case in roll groups $R_2$ and $R_3$. All roll replacement can be performed, for example, by equipment which operates in the area situated on the operating side at the machine level. Such equipment, however, is not included within the scope of the instant invention.

The soft rolls 20*a* and 20*b* are preferably deflection-compensated rolls, especially in wider calender apparatus. In some cases, the rolls 21 may also be deflection-compensated rolls. In the case of narrower calenders, so-called deflection-minimized rolls or even conventional rolls not including such compensation can be used.

Obviously, numerous modifications and variations of the present invention are possible in the light of the above teachings. It is therefore to be understood that within the scope of the claims appended hereto, the invention may be practiced otherwise than specifically disclosed herein.

What is claimed is:

1. On-machine supercalender apparatus adapted to be located at the discharge end of a paper making machine and arranged so as to function as a supercalender, comprising:

hard and soft calender rolls forming soft calendering nips with each other, said calender rolls being arranged in at least three roll groups, each of said calender roll groups consisting of three calender rolls including a central roll and two outer rolls;

said calender roll groups being separate from each other such that the calender rolls of one group are neither directly nor indirectly in nip contact with the calender rolls of another group; and wherein the central roll of each calender roll is constituted by a hard calender roll and the two outer rolls are constituted by soft calender rolls which form a pair of soft calendering nips with the hard central roll, at least a majority of said soft calender rolls being replaceable during operation of the apparatus without any significant interruption in operation of the apparatus.

2. A combination of claim 1 wherein the calender rolls are arranged such that a web passes through the nips defined by at least two of said calender roll groups which are in constant operation and wherein at least one calender roll group is arranged such that the web does not pass through the nips thereof so that said at least one roll group is maintained in a non-operational mode whereby the soft rolls thereof can be replaced during the supercalendering operation with minimal interruption.

3. The combination of claim 1 wherein the calender rolls of each roll group are arranged in a substantially vertical stack so that each roll group includes upper and lower soft rolls and a central hard roll.

4. The combination of claim 3 wherein said apparatus includes frame structure and wherein in each roll group, the upper soft calender roll is mounted on bearing supports which are rigidly connected to the frame structure, the hard central roll is mounted on bearing supports which are mounted to the frame structure for movement in a substantially vertical plane, and the lower soft roll is mounted on bearing supports which are mounted to the frame structure for movement with respect thereto, and further including power means associated with the bearing supports for said lower soft roll for adjusting the position of the latter whereby the calender nips can be loaded or opened in a rapid manner.

5. The combination of claim 1 wherein the calender rolls of at least one calender group are mounted so as to be reversibly rotatable.

6. The combination of claim 1 wherein at least a majority of said calender roll groups are arranged in a manner such that the web is guided only by said hard calender rolls.

* * * * *